US005604930A

United States Patent [19]

Petit et al.

[11] Patent Number: 5,604,930

[45] Date of Patent: Feb. 25, 1997

[54] PAIR OF HINGES WITH SYNCHRONIZED OPERATION FOR THE ATTACHMENT OF A RETRACTABLE VISOR TO A HELMET

[75] Inventors: Eric Petit, Martignas S/Jalle; Vincent Vitte, Bordeaux, both of France

[73] Assignee: Sextant Avionique, Meudon la Foret, France

[21] Appl. No.: 528,765

[22] Filed: Sep. 15, 1995

[30] Foreign Application Priority Data

Sep. 20, 1994 [FR] France ..... 94 11176

[51] Int. Cl.[6] ..... A42B 3/22

[52] U.S. Cl. ..... 2/6.5; 2/424

[58] Field of Search ..... 2/6.2, 6.3, 6.5, 2/10, 15, 410, 422, 424, 6.1

[56] References Cited

U.S. PATENT DOCUMENTS

| | | | |
|---|---|---|---|
| 3,050,735 | 8/1962 | Newman et al. | 2/6.5 |
| 3,128,469 | 4/1964 | Lobelle | 2/6.3 |
| 3,383,706 | 5/1968 | Lobelle | 2/6.5 |
| 3,473,166 | 10/1969 | Lobelle | 2/6.5 |
| 4,621,377 | 11/1986 | Pennell | 2/6.5 |
| 5,329,642 | 7/1994 | Dampney | 2/424 |

FOREIGN PATENT DOCUMENTS

| | | |
|---|---|---|
| 0080202 | 6/1983 | European Pat. Off. . |
| 2637468 | 4/1990 | France . |
| 2688661 | 9/1993 | France . |
| 9007028 | 8/1990 | Germany . |
| 9207186 | 10/1992 | Germany . |
| 2014432 | 8/1979 | United Kingdom . |
| 2054351 | 2/1981 | United Kingdom . |
| 8704323 | 7/1987 | WIPO . |

*Primary Examiner*—Michael A. Neas
*Attorney, Agent, or Firm*—Oblon, Spivak, McClelland, Maier & Neustadt, P.C.

[57] ABSTRACT

The disclosed pair of hinges enables the visor to be swung with respect to the shell of the helmet in a complex motion that starts in a turned-down position by a motion of translation moving the visor away from the shell of the helmet in order to move it away from a shoulder or joint, if any, and continues up to a raised position by a rotation that retracts the visor over the shell of the helmet. They are synchronized mechanically by a system of gear wheels meshing with racks connected by a sheathed cable and being operated by just one hand by one of the handles with which it is fitted.

5 Claims, 6 Drawing Sheets

PAIR OF HINGES WITH SYNCHRONIZED OPERATION FOR THE ATTACHMENT OF A RETRACTABLE VISOR TO A HELMET

BACKGROUND OF THE INVENTION

1. Description of the Prior Art

The present invention relates to a hinged attachment for helmet visors that can be operated by one hand only, enabling the visor to be tilted or swung with respect to the helmet in a motion where it goes from a position where it is turned down over the face to a raised position uncovering the face and, conversely, in a complicated movement that starts by a translation that moves the visor away from the helmet in order to release it from a joint or shoulder if any and that continues up to a raised position by a rotation that retracts the visor above the face.

Visor-fitted helmets are used to protect a pilot's head in the event of impact. The helmet protects the cranium while the visor protects the face and provides visual comfort in an aggressive environment: for example an environment with wind, dust, light, fog, etc. It also, if necessary, provides protection in a chemically aggressive environment. In the latter case, there needs to be tight sealing between the shell of the helmet and the visor in its turned-down position. This requires the presence of a peripheral joint and makes it necessary for the visor to meet the helmet frontally causing the visor to have a swinging motion that is not limited to a simple rotation and that can no longer be obtained by direct handling of the visor because such handling would require the pilot to perform a complicated movement requiring both hands.

Furthermore, certain helmets are fitted with a helmet mounted display that is an optical image projection system using a semi-reflective zone of the visor in the turned-down position to display piloting assistance symbols before the pilot's eyes. This requires very precise settings and excellent reproducibility of the position of the visor with respect to the other optical elements borne by the helmet.

2. Description of the Prior Art

There is a known way, described in the European patent application No. EP-A 88344, for making hinges that give the visor of a helmet a complex swinging motion that starts, in the turned-down position, with a translation that moves the visor away from the helmet, in order to release it from a shoulder, and continues up to a raised position by a rotation that retracts the visor above the face. However, these hinges need to be actuated by individual electrical motors. This makes them bulky and requires the helmet to be fitted with a battery that makes it heavy and complicates its maintenance.

SUMMARY OF THE INVENTION

It is an aim of the present invention to provide a hinged attachment of a visor on a helmet that conveys a complex swinging motion based on translation and rotation to the visor and that can be controlled directly by the wearer of the helmet with only one hand by the simple rotation of a handle without requiring the assistance of electrical motors.

It is also an aim of the invention to provide a hinged attachment of a visor to a helmet that is simple, reliable and costs little, all at the same time.

An object of the invention is a pair of hinges with synchronized operation for the fastening of a retractable visor to a helmet, wherein each hinge comprises:

a pivot pin pivoting about an axis that is fixed with respect to the side wall of the helmet;

a side fastening lug for the visor fitted on to the pivot pin by means of a buttonhole-shaped hole whose width permits, in addition to the rotational motion, a clearance for the visor in translation with respect to the helmet, said lug being provided with a cam-shaped notch in which there slides a finger fixedly joined to the side wall of the helmet to guide the visor in translation and rotation when it is swinging with respect to the helmet;

a rotary wrist pin fixed to the pivot pin that gets engaged in an ovalized hole of the fastening lug so that, by its motion of rotation with the pivot pin, it causes the swinging of said fastening lug;

a handle fixed to said wrist pin on the exterior of the hinge so that it can be rotated by hand; and elastic draw-back means drawing back the wrist pin in the end positions of its range of clearance in rotation;

and wherein said hinges are coupled by mechanical means of synchronization that synchronize the motions of their wrist pins.

Advantageously, the mechanical synchronization means comprise: a cable that slides in a sheath connecting the two hinges in following the contour of the shell of the helmet and is fitted, at its two ends, with a rack and two toothed gear wheels, fixedly joined to the pivot pins and the wrist pins of the hinges, that mesh in with the racks so that the rotational motion of a wrist pin gives rise to a sliding of the cable in its sheath and an identical rotational motion of the other wrist pin. The gear wheels and the racks are then mounted in gear boxes housed at the base of each hinge.

Advantageously, the handle has the shape of shell with recesses on its external face, making it easier for it to be grasped.

BRIEF DESCRIPTION OF THE DRAWINGS

Other features and advantages of the invention shall emerge from the following description of an embodiment given by way of an example. This description shall be given hereinafter with reference to the drawings of which.

MORE DETAILED DESCRIPTION

Figure 1:
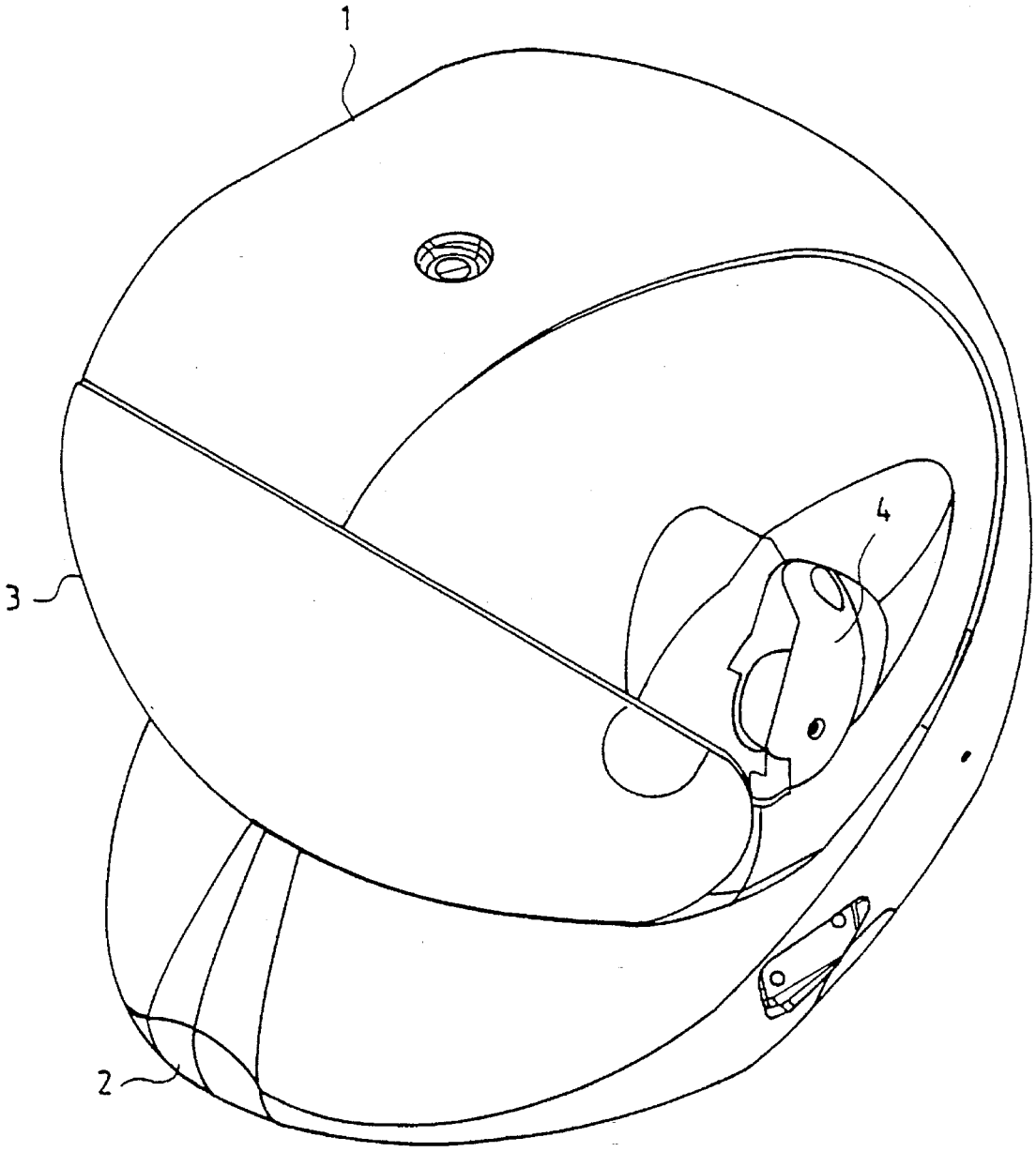
FIG. 1 shows a pilot's helmet fitted out with a pair of hinges according to the invention.

As can be seen in FIG. 1, the helmet has a protective shell 1 encasing the cranium except for the face. This shell 1 is closed in front by a fairing 2 in its lower part and by a visor 3 in its upper part. The visor 3 is hinged laterally to the shell 1 of the helmet so as to be capable of being lowered or raised. The visor is controlled by means of a handle 4 that caps each hinge.

Figure 2:
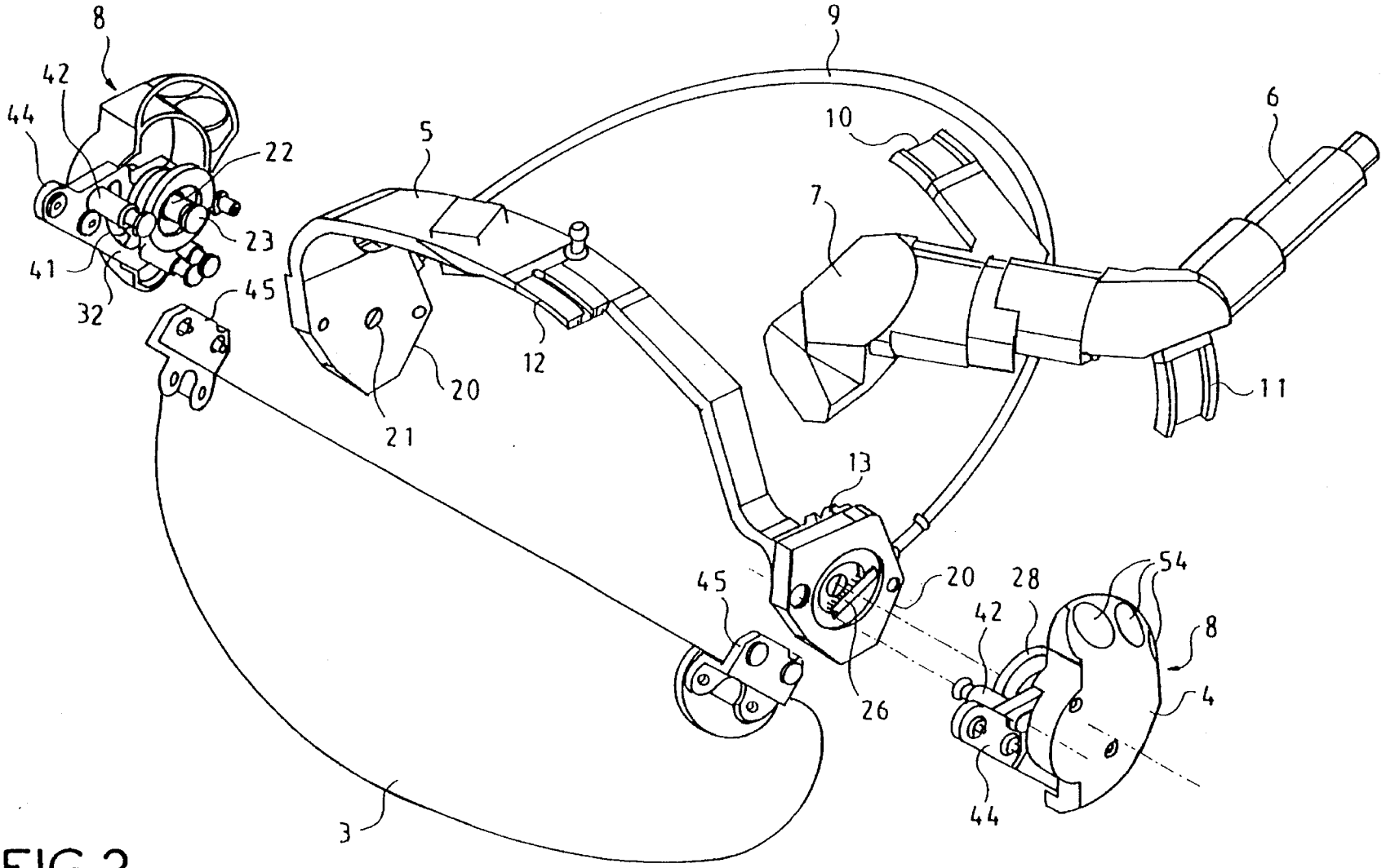
FIG. 2 gives an exploded view in perspective of a supporting mount of a helmet mounted display designed to be attached to the interior of the shell of the helmet, the hinges for fastening the visor and a helmet mounted display that is set up on the mount.

The shell 1 of the helmet, as can be seen in FIG. 2, encloses a hoop-shaped mount 5 that supports the image-generating tube 6 associated with an optical image projection system 7 on a semi-reflective zone of the visor and the hinges 8 for the fastening of the visor 3.

The image generator tube 6 and the associated optical system 7 are set up on the mount 5 by means of lugs 10, 11 that get fitted into tongues, one of which referenced 12 is placed at the top of the mount 5 while the other referenced 13 is placed on the back of the support of a hinge 8.

The hinges 8 for the attachment of the visor 3 to the helmet are mounted at the ends of the hoop forming the mount 5, at the level of the helmet-wearer's temple, and are joined together by a sheathed cable 9 for the synchronization of motion.

The attachment of the visor 3 to the shell 1 of the helmet by means of the mount 5, and not directly, enables the combining in a separate assembly of the different elements of the display module, of which the semi-reflective zone of the visor 3 forms part. This makes it easier to carry out the settings of the respective positions of the elements of the optical image projection system, avoids problems raised by the lack of rigidity of the shell 1 of the helmet with respect to the stability of the setting of the relative positions of the visor and of the other elements of the optical image projection system and simplifies the maintenance of the helmet visor.

Each end of the hoop forming the mount 5 ends in a substantially vertical ear 20 pierced with a median hole 21 for a horizontal pivot pin 22 having a flattened circular head 23 extended by a rod 24. The pivot pin 22 is threaded into the hole 21 of the ear 20 by the interior. Its circular head 23 gets placed flat against the rear wall of the ear 20 while its rod 24 goes beyond the front wall of the ear horizontally into a gear box.

Figure 3:
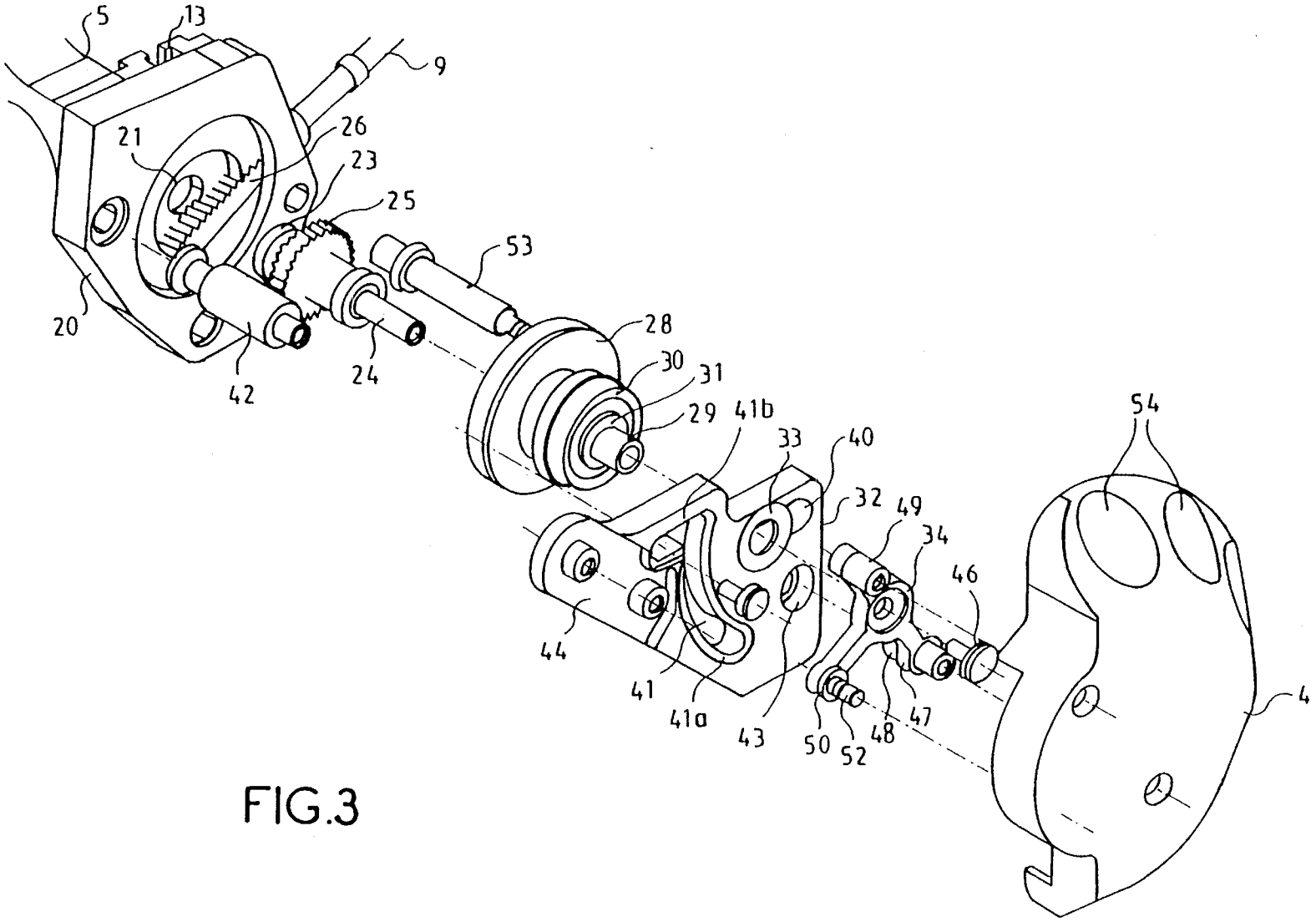
FIG. 3 shows an exploded view in perspective of a hinge for fastening the visor to the helmet according to the invention.

On the rod 24 of the pivot pin, there is fitted a toothed gear wheel 25 that can be seen in FIG. 3. This toothed gear wheel 25 is fixedly joined in rotation with the pivot pin 22 by means of grooves having complementary profiles made on the surface of the rod 24 of the pivot pin and inside the bore of the gear wheel 25 itself. This gear wheel 25 is housed in the gear box along with a rack 26 with which it meshes. The rack 26, which is driven by a to-and-fro motion, is attached to the rack of the other hinge by means of a cable sliding in a sheath 9 that connects the gear boxes of the two hinges.

To obtain motions in the same direction for the toothed gear wheels of both hinges, one of the racks, namely 26 shown in FIG. 3, meshes with the base of the toothed gear wheel 25 while the other rack which is not shown meshes with the top of the toothed gear wheel.

Above the toothed gear wheel 25, a lid 28 of the gear box gets fitted on to the pivot pin 22 to close the gear box and ensure that the gear wheel 25 and the rack 26 are held in position. This lid 28 has an external tubular extension 29 used as a hinge pin surrounded by a ring-shaped plate 30 used as a bearing for the hinge.

On the tubular part 29 of the lid 28 of the gear box, there is first of all is a first washer 31, then the second pivoting and sliding part of the hinge used as a side fastening lug 32 for the visor 3, a second washer 33 and finally a wrist pin 34 covered with a handle 4.

The first and second washers 31, 33 are used as thickness shims. They are strippable. By adjusting their individual thicknesses and at the same time preserving a constant overall thickness, it is possible to make the lateral position of the fastening lug 32 of the visor vary with respect to the mount 5 for a fine transversal setting of the position of the visor with respect to the helmet. This is useful for the setting of the elements of the optical image projection system.

The lateral fastening lug 32 of the visor is fitted over the tubular extension 29 of the lid 28 of the gear box surrounding the rod of the pivot pin 22 by means of a buttonhole-shaped hole 40 whose width determines the range of clearance, in translation, of the visor with respect to the helmet. It is provided with a cam-shaped notch 41 in which there slides a guiding finger 42 fixed to the external wall of the gear box and fixedly joined to the side wall of the helmet to define the translatory and rotational components of the swinging movement of the visor with respect to the helmet. This notch 41 has a part 41*a* shaped like the arc of a circle defining the rotational motion by which the visor is conveyed from its retracted position to its turned-down position, extended by a rectilinear part 41*b*, almost radial with respect to the axis of rotation and pointed towards the exterior of the part 41 a shaped like the arc of a circle. This part 41*b* has the same length and the same orientation as the buttonhole, defining the motion of translation that enables the visor to be brought towards the helmet enabling it to meet the helmet when it is turned down.

The side fastening lug 32 of the visor furthermore has an ovalized hole 43 so that it can be drawn mechanically by the wrist pin 34 and a flange 44 enabling it to be attached to the visor 3. As can be seen in FIG. 2, the flange 44 is screwed into an interposed part 45 riveted to the visor.

The wrist pin 34 is screwed into the end of the rod 24 of the pivot pin by means of a screws 46 so as to be fixedly joined in rotation with this screw 46 like the toothed gear wheel 25. It has a main arm 47 ending in a driving toe 48 that is pointed towards the side fastening lug 32 and moves freely in the ovalized hole 43. The wrist pin 34 also has two auxiliary arms positioned in a star shape, one arm 49 for the fastening of a shell-shaped handle 4 enabling the wrist pin 34 to be controlled by hand, and another arm 50 to attach a spring drawing back the wrist pin 34 to its end positions of play corresponding to the turned-down and retracted positions of the visor 3.

Figure 4:
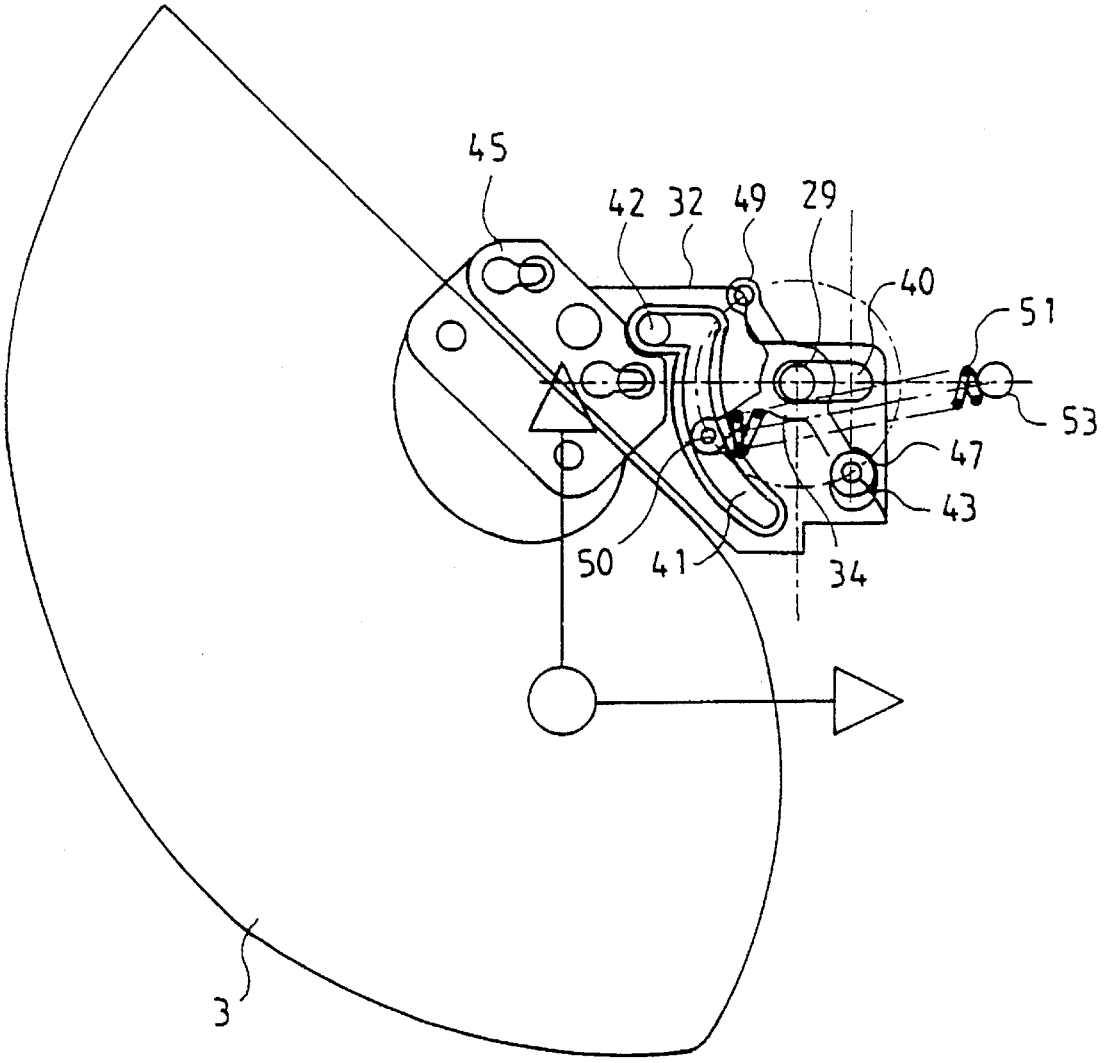
FIGS. 4, 5 and 6 show a front view of the respective positions of the main parts of a hinge during different stages of the swinging motion of the visor.
Figure 6:
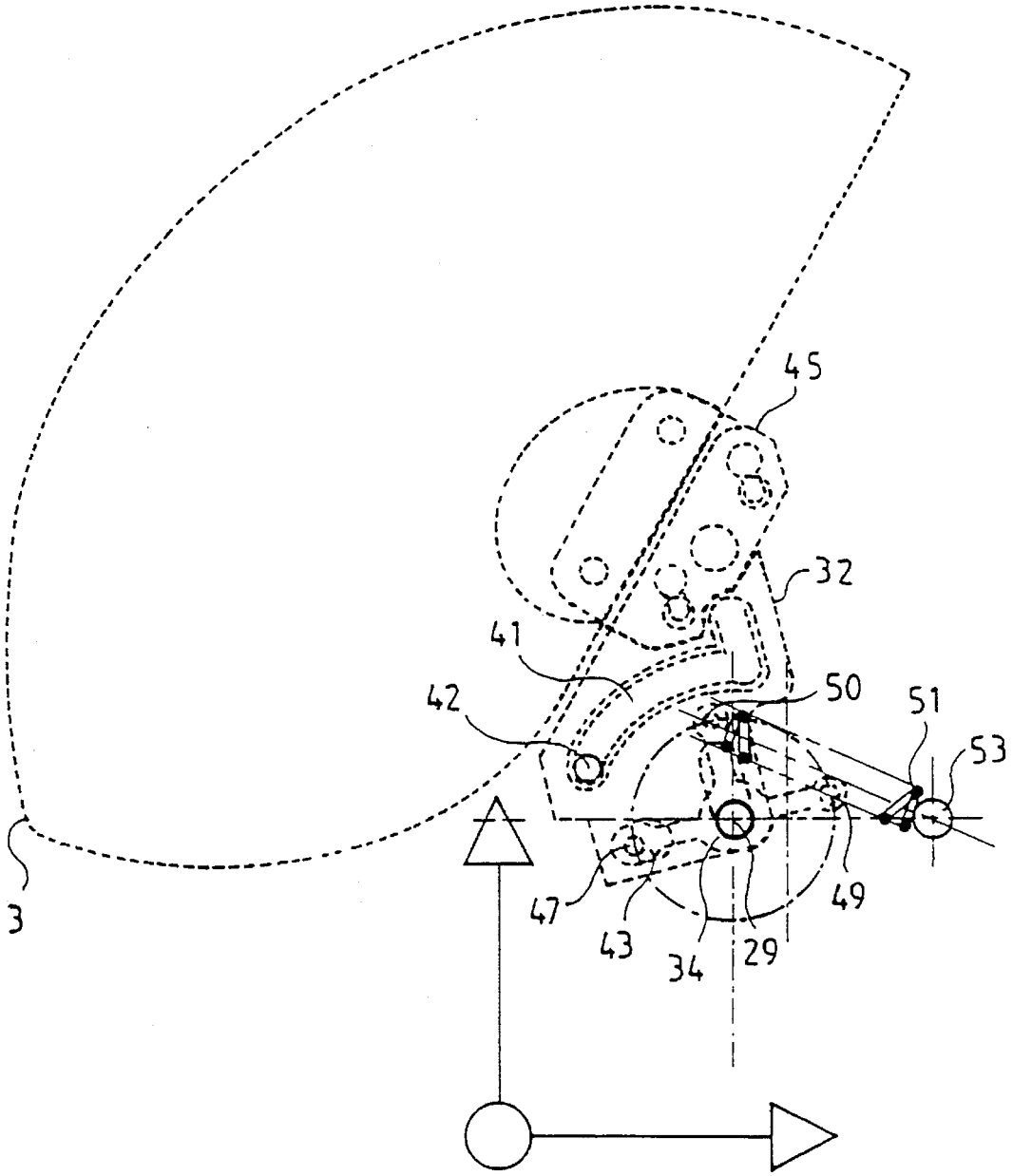

The pull-back spring that pulls the wrist pin 34 back to its end positions can be seen in FIGS. 4 and 6. It is a pull-back spring 51 supported between a toe 52 of the auxiliary arm 50 of the wrist pin 34 pointed towards the interior of the handle 4 and a fixed pin 53 attached to the external wall of the gear box.

The handle 4 has the shape of a shell matching the shape of the palm with recesses 54 for the fingertips so that it is easy to handle it without looking.

FIG. 4 gives a front view of the respective positions of the wrist pin 34, the side fastening lug 32 of the visor and the pull-back spring 51 when the visor 3 is in the turned-down position. The guiding finger 42 is at the rectilinear end of the notch 41, the control toe 48 of the wrist pin is at the top of the ovalized hole 43 of the side fastening lug 32 and the pivot pin 22 is at the far left of the buttonhole 40 on the notch side 41.

Figure 5:
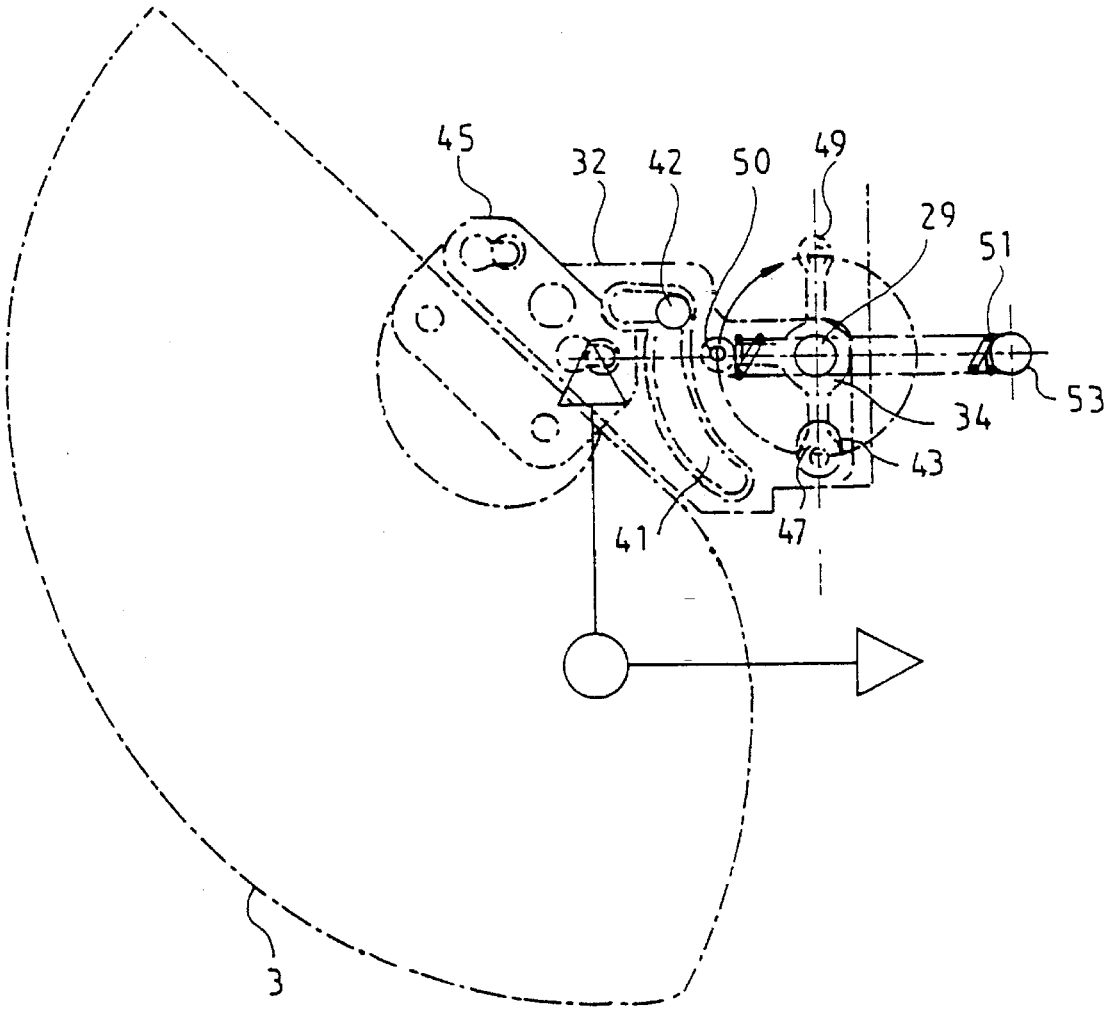

FIG. 5 gives a view, which is again a front view, of the respective positions of the wrist pin 34, the side fastening lug 32 and the pull-back spring 51 when the visor is in the intermediate turned-down position but already moved away from the edge of the helmet. The guiding finger 42 is at the junction of the rectilinear and circular parts of the notch 41, the control toe 48 of the wrist pin is at the base of the ovalized hole 43 of the side fastening lug 32 and the pivot pin 22 is at the far right of the buttonhole 40 on the side opposite the notch 41.

FIG. 6 gives a view which is again a front view of the respective positions of the wrist pin 34, the side fastening lug 32 and the pull-back spring 51 when the visor is in the position where it is retracted above the face. The guiding pin 42 is at the end of the circular part of the notch 41, the control toe 48 of the wrist pin remaining at the base of the ovalized hole 43 and the pivot pin 22 at the far right of the buttonhole 40 on the is side opposite the notch 41.

When the handle 4 has a rotational motion imposed on it by hand, it drives the wrist pin 34 and the toothed gear wheel 25 rotationally. The wrist pin 34 prompts the swinging of the side fastening lug 32 and hence that of the visor 3 in a complex motion of rotation and translation determined by the guiding of the finger 42 in the notch 41 while the toothed gear wheel 25 shifts the rack 26 driving the cable in translation in its sheath 27. The cable shifts the rack of the other hinge which then causes the rotation of the toothed gear wheel and the wrist pin of the other hinge which is then activated in synchronism without there being any need to use its handle.

Through this system of synchronized hinges that can be actuated by only one hand, a complex motion is obtained for the visor enabling this visor to meet the edge of the helmet frontally when it is turned down without there being any substantially greater space occupied by these hinges or any difficulty of controlling the hinges greater than that associated with conventional hinges that allow only a motion of swinging by rotation.

What is claimed is:

1. A pair of hinges with synchronized operation for the fastening of a retractable visor to a helmet, wherein each hinge comprises:

a pivot pin pivoting about an axis that is fixed with respect to the side wall of the helmet;

a side fastening lug for the visor fitted on to the pivot pin by means of a buttonhole-shaped hole whose width permits, in addition to the rotational motion, a clearance for the visor in translation with respect to the helmet, said lug being provided with a cam-shaped notch in which there slides a finger fixedly joined to the side wall of the helmet to guide the visor in translation and rotation when it is swinging with respect to the helmet;

a rotary wrist pin fixed to the pivot pin that gets engaged in an ovalized hole of the fastening lug so that, by its motion of rotation with the pivot pin, it causes the swinging of said fastening lug;

a handle fixed to said wrist pin on the exterior of the hinge so that it can be rotated by hand; and elastic draw-back means drawing back the wrist pin in the end positions of its range of clearance in rotation;

and wherein said hinges are coupled by mechanical means of synchronization that synchronize the motions of their wrist pins.

2. A pair of hinges according to claim 1, wherein the mechanical synchronization means comprise: a cable that slides in a sheath connecting the two hinges in following the contour of the shell of the helmet and is fitted, at its two ends, with a rack and two toothed gear wheels, fixedly joined to the pivot pins and the wrist pins of the hinges, that mesh in with the racks so that a rotational motion of a wrist pin gives rise to a sliding of the cable in its sheath and an identical rotational motion of the other wrist pin.

3. A pair of hinges according to claim 2, wherein said gear wheels and the racks are mounted in a gear box housed at the base of each hinge.

4. A pair of hinges according to claim 1, wherein said handle has the shape of a shell with recesses for the fingertips on its external face, making it easier for it to be grasped.

5. A pair of hinges according to claim 1, wherein said elastic draw-back means pulling back the wrist pin in the end positions of its range of clearance comprise a pull-back spring attached between a toe of an auxiliary arm of the wrist pin and a fixed pin fixedly joined to the side wall of the helmet.

* * * * *